US009739542B2

(12) United States Patent
Hedberg et al.

(10) Patent No.: US 9,739,542 B2
(45) Date of Patent: Aug. 22, 2017

(54) HEAT TRANSFER PLATE AND PLATE HEAT EXCHANGER COMPRISING SUCH A HEAT TRANSFER PLATE

(71) Applicant: ALFA LAVAL CORPORATE AB, Lund (SE)

(72) Inventors: Magnus Hedberg, Ronneby (SE); Johan Nilsson, Malmo (SE)

(73) Assignee: ALFA LAVAL CORPORATE AB, Lund (SE)

( * ) Notice: Subject to any disclaimer, the term of this patent is extended or adjusted under 35 U.S.C. 154(b) by 183 days.

(21) Appl. No.: 14/438,149

(22) PCT Filed: Oct. 10, 2013

(86) PCT No.: PCT/EP2013/071149

§ 371 (c)(1),
(2) Date: Apr. 23, 2015

(87) PCT Pub. No.: WO2014/067757

PCT Pub. Date: May 8, 2014

(65) Prior Publication Data

US 2015/0276319 A1 Oct. 1, 2015

(30) Foreign Application Priority Data

Oct. 30, 2012 (EP) ..... 12190493

(51) Int. Cl.
*F28F 3/08* (2006.01)
*F28D 9/00* (2006.01)
(Continued)

(52) U.S. Cl.
CPC ..... *F28D 9/0093* (2013.01); *F28F 3/046* (2013.01); *F28F 3/083* (2013.01); *F28D 1/0308* (2013.01)

(58) Field of Classification Search
CPC .... F28D 9/0093; F28D 1/0308; F28D 9/0025; F28D 9/005; F28F 3/046; F28F 3/083; F28F 3/042
See application file for complete search history.

(56) References Cited

U.S. PATENT DOCUMENTS 3,783,090 A 1/1974 Andersson et al.
4,434,643 A * 3/1984 Almqvist ..... B21D 53/04 29/890.039
(Continued)

FOREIGN PATENT DOCUMENTS

CN 200968801 Y 10/2007
CN 101213414 A 7/2008
(Continued)

OTHER PUBLICATIONS

International Search Report (PCT/ISA/210) mailed on Oct. 29, 2013, by the European Patent Office as the International Searching Authority for International Application No. PCT/EP2013/071149.
(Continued)

*Primary Examiner* — Ryan J Walters
*Assistant Examiner* — Jon T Schermerhorn
(74) *Attorney, Agent, or Firm* — Buchanan Ingersoll & Rooney PC

(57) ABSTRACT

A heat transfer plate comprises a first end area, a heat transfer area and a second end area along a longitudinal center axis of the plate which divides the plate into first and second halves delimited by first and second long sides respectively. The first end area comprises an inlet port hole, a distribution area and a transition area. The transition area adjoins the distribution area and the heat transfer area. The distribution area has a distribution pattern of projections and depressions, the transition area has a transition pattern of projections and depressions, and the heat transfer area has a heat transfer pattern of projections and depressions. An
(Continued)

imaginary straight line extends between two end points of each transition projection with an angle relative to the longitudinal center axis. The angle varies between the transition projections and increases from the first long side to the second long side.

14 Claims, 5 Drawing Sheets

(51) Int. Cl.
*F28F 3/04* (2006.01)
*F28D 1/03* (2006.01)

(56) References Cited

U.S. PATENT DOCUMENTS

| | | | | |
|---|---|---|---|---|
| 5,174,370 | A * | 12/1992 | Hallgren | B01D 1/221 165/147 |
| 6,180,846 | B1 * | 1/2001 | Dandekar | B01J 8/0285 252/373 |
| 8,646,517 | B2 * | 2/2014 | Blomgren | F28D 9/005 165/167 |
| 2005/0039896 | A1 * | 2/2005 | Laine | F28D 9/0012 165/157 |
| 2008/0210414 | A1 * | 9/2008 | Blomgren | F28D 9/005 165/166 |
| 2008/0223564 | A1 * | 9/2008 | Bjornsson | F28D 9/005 165/167 |
| 2009/0159251 | A1 * | 6/2009 | Blomgren | F28D 9/005 165/167 |
| 2011/0139419 | A1 * | 6/2011 | Blomgren | F28D 9/005 165/170 |
| 2015/0247682 | A1 * | 9/2015 | Nilsson | F28F 3/046 165/185 |
| 2015/0253087 | A1 | 9/2015 | Hedberg et al. | |
| 2015/0276319 | A1 * | 10/2015 | Hedberg | F28F 3/046 165/166 |
| 2015/0330720 | A1 | 11/2015 | Hedberg et al. | |

FOREIGN PATENT DOCUMENTS

| | | | | |
|---|---|---|---|---|
| CN | 201364067 | Y | | 12/2009 |
| CN | 203464823 | U | | 3/2014 |
| GB | 1 339 542 | A | | 12/1973 |
| JP | S52-000271 | B1 | | 1/1977 |
| JP | H01-503254 | A | | 11/1989 |
| JP | H06-241672 | A | | 9/1994 |
| JP | H07-260386 | A | | 10/1995 |
| JP | 08271172 | A | * | 10/1996 |
| JP | H08-271172 | A | | 10/1996 |
| JP | H08-271173 | A | | 10/1996 |
| JP | H09-079782 | A | | 3/1997 |
| JP | H09-089482 | A | | 4/1997 |
| JP | 2001-099583 | A | | 4/2001 |
| JP | 2009-500588 | A | | 1/2009 |
| JP | 2009-540257 | A | | 11/2009 |
| RU | 2 431 795 | C2 | | 10/2011 |
| RU | 2 432 541 | C2 | | 10/2011 |
| SE | 528 879 | C2 | | 3/2007 |
| WO | 88/08508 | A1 | | 11/1988 |
| WO | WO 99/49271 | A2 | | 9/1999 |
| WO | WO 2007/004939 | A1 | | 1/2007 |
| WO | 2007/142590 | A1 | | 12/2007 |
| WO | 2007/142592 | A1 | | 12/2007 |
| WO | 2009/154543 | A1 | | 12/2009 |
| WO | 2011/133087 | A2 | | 10/2011 |

OTHER PUBLICATIONS

Written Opinion (PCT/ISA/237) mailed on Oct. 29, 2013, by the European Patent Office as the International Searching Authority for International Application No. PCT/EP2013/071149.

An English Translation of the Search Report issued on Mar. 20, 2015, by the State Intellectual Property Office of People's Republic China in corresponding Chinese Patent Application No. 201310087646.3. (2 pages).

An English Translation of the Office Action (Notice of Reasons for Rejection) issued on Apr. 4, 2016, by the Japanese Patent Office in corresponding Japanese Patent Application No. 2015-538363. (8 pages).

An English Translation of the Office Action (Decision of Grant) issued on Jul. 6, 2016, by the Russian Patent Office in corresponding Russian Patent Application No. 2015120585/06(031862). (4 pages).

* cited by examiner

HEAT TRANSFER PLATE AND PLATE HEAT EXCHANGER COMPRISING SUCH A HEAT TRANSFER PLATE

TECHNICAL FIELD

The invention relates to a heat transfer plate according to the preamble of claim 1. The invention also relates to a plate heat exchanger comprising such a heat transfer plate.

BACKGROUND ART

Plate heat exchangers typically consist of two end plates in between which a number of heat transfer plates are arranged in an aligned manner, channels being formed between the heat transfer plates. Two fluids of initially different temperatures can flow through every second channel for transferring heat from one fluid to the other, which fluids enter and exit the channels through inlet and outlet port holes in the heat transfer plates.

Typically, a heat transfer plate comprises two end areas and an intermediate heat transfer area. The end areas comprise the inlet and outlet port holes and a distribution area pressed with a distribution pattern of projections and depressions, such as ridges and valleys, in relation to a reference plane of the heat transfer plate. Similarly, the heat transfer area is pressed with a heat transfer pattern of projections and depressions, such as ridges and valleys, in relation to said reference plane. The ridges of the distribution and heat transfer patterns of one heat transfer plate is arranged to contact, in contact areas, the valleys of the distribution and heat transfer patterns of another, adjacent, heat transfer plate in a plate heat exchanger. The main task of the distribution area of the heat transfer plates is to spread a fluid entering the channel across the width of the heat transfer plate before the fluid reaches the heat transfer area, and to collect the fluid and guide it out of the channel after it has passed the heat transfer area. On the contrary, the main task of the heat transfer area is heat transfer.

Since the distribution area and the heat transfer area have different main tasks, the distribution pattern normally differs from the heat transfer pattern. The distribution pattern is such that it offers a relatively weak flow resistance and low pressure drop which is typically associated with a more "open" distribution pattern design, such as a so-called chocolate pattern, offering relatively few, but large, contact areas between adjacent heat transfer plates. The heat transfer pattern is such that it offers a relatively strong flow resistance and high pressure drop which is typically associated with a more "dense" heat transfer pattern design, such as a so-called herringbone pattern, offering more, but smaller, contact areas between adjacent heat transfer plates.

The locations and density of the contact areas between two adjacent heat transfer plates are dependent, not only on the distance between, but also on the direction of, the ridges and the valleys of both heat transfer plates. As an example, if the patterns of the two heat transfer plates are similar but mirror inverted, as is illustrated in FIG. 1*a* where the solid lines correspond to the ridges of the bottom heat transfer plate and the dashed lines correspond to the valleys of the top heat transfer plate, then the contact areas between the heat transfer plates (cross points) will be located on imaginary equidistant straight lines (dashed-dotted) which are perpendicular to a longitudinal center axis L of the heat transfer plates. On the contrary, as is illustrated in FIG. 1*b*, if the ridges of the bottom heat transfer plate are less "steep" than the valleys of the top heat transfer plate, the contact areas between the heat transfer plates will instead be located on imaginary equidistant straight lines which are not perpendicular to the longitudinal center axis. As another example, a smaller distance between the ridges and valleys corresponds to more contact areas. As a final example, illustrated in FIG. 1*c*, "steeper" ridges and valleys correspond to a larger distance between the imaginary equidistant straight lines and a smaller distance between the contact areas arranged on the same imaginary equidistant straight line.

At the transition between the distribution area and the heat transfer area, i.e. where the plate pattern changes, the strength of the heat transfer plate may be somewhat reduced as compared to the strength of the rest of the plate. Further, the more scattered the contact areas are at the transition, the worse the strength may be. Consequently, similar but mirror inverted patterns of two adjacent heat transfer plates with steep, densely arranged ridges and valleys typically involves a stronger transition than differing patterns with less steep, less densely arranged ridges and valleys.

A plate heat exchanger may comprise one or more different types of heat transfer plates depending on its application. Typically, the difference between the heat transfer plate types lies in the design of their heat transfer areas, the rest of the heat transfer plates being essentially similar. As an example, there may be two different types of heat transfer plates, one with a "steep" heat transfer pattern, a so-called low-theta pattern, which is typically associated with a relatively low heat transfer capacity, and one with a less "steep" heat transfer pattern, a so-called high-theta pattern, which is typically associated with a relatively high heat transfer capacity. A plate pack containing only low-theta heat transfer plates will be relatively strong since it is associated with a maximum number of contact areas arranged at the same distance from the transition between the distribution and heat transfer areas. On the other hand, a plate pack containing alternately arranged high-theta and low-theta heat transfer plates will be relatively weak since it is associated with a smaller number of contact areas arranged at the same distance from the transition.

The above problem is described further in applicant's Swedish patent SE 528879 which is hereby incorporated herein by reference and which also discloses a solution to this problem. The solution involves the provision of a narrow band between the distribution and heat transfer areas of the heat transfer plates irrespective of plate type. The narrow band is provided with a herringbone pattern, more particularly densely arranged "steep" ridges and valleys. Thereby, the transition to the distribution area will be the same and relatively strong irrespective of which types of heat transfer plates the plate pack contains.

However, even if the narrow band above solves the strength issue at the transition to the distribution area, it occupies valuable surface area of the heat transfer plates without being associated with either effective fluid distribution due to the density of the ridges and valleys, or effective heat transfer due to the "steepness" of the ridges and valleys. More particularly, the heat transfer capacity of the narrow band is relatively low as compared to the heat transfer capacity of a heat transfer surface of a high-theta heat transfer plate. However, the heat transfer capacities of the narrow band and the heat transfer surface of a low-theta heat transfer plate may be about the same.

SUMMARY

An object of the present invention is to provide a heat transfer plate with a relatively strong transition to the distribution area as well as a more effective utilization of the heat transfer plate surface area as compared to prior art. The basic concept of the invention is to provide a transition area between the distribution area and the heat transfer area of the heat transfer plate, which transition area is pressed with a pattern of projections and depressions that diverge from each other. Another object of the present invention is to provide a plate heat exchanger comprising such a heat transfer plate. The heat transfer plate and the plate heat exchanger for achieving the objects above are defined in the appended claims and discussed below.

A heat transfer plate according to the present invention has a central extension plane and comprises a first end area, a heat transfer area and a second end area arranged in succession along a longitudinal center axis of the heat transfer plate. The longitudinal center axis divides the heat transfer plate into a first and a second half delimited by a first and second long side, respectively. The first end area comprises an inlet port hole arranged within the first half of the heat transfer plate, a distribution area and a transition area. The transition area adjoins the distribution area along a first borderline and the heat transfer area along a second borderline. The distribution area has a distribution pattern of distribution projections and distribution depressions in relation to the central extension plane, the transition area has a transition pattern of transition projections and transition depressions in relation to the central extension plane and the heat transfer area has a heat transfer pattern of heat transfer projections and heat transfer depressions in relation to the central extension plane. The transition pattern differs from the distribution pattern and the heat transfer pattern. Further, the transition projections comprise transition contact areas arranged for contact with another heat transfer plate. An imaginary straight line extends between two end points of each transition projection with an angle in relation to the longitudinal center axis. The heat transfer plate is characterized in that the angle is varying between the transition projections and increasing in a direction from the first long side to the second long side.

The longitudinal center axis is parallel to the central extension plane.

Heat transfer plates are often essentially rectangular. Then, the first and second long sides are essentially parallel to each other and to the longitudinal center axis.

The transition projections (and transition depressions) may have any shape, such as a straight or curved or a combination thereof, and they may, or may not, have different shapes as compared to each other. In the case of a straight transition projection, the corresponding imaginary straight line will extend along the complete transition projection. This will not be the case for a non-straight transition projection.

All the transition projections may be associated with different angles, or some, but not all, of the transition projections may be associated with the same angle, as long as the angle of a transition projection closer to the second long side is not smaller than the angle of a transition projection closer to the first long side.

As described by way of introduction, a main task of the distribution area is to lead a fluid from the inlet port hole towards the heat transfer area, and thereby the transition area, and to spread the fluid across the width of the heat transfer plate. In that the angle of the transition projections increases with the distance to the inlet port hole of the heat transfer plate, also the transition area will contribute considerably to the spreading of the fluid across the heat transfer plate, especially the spreading of the fluid across the outer part, arranged along the second long side, of the second half of the heat transfer plate. Further, such an increasing angle of the transition projections is also associated with an increasing heat transfer capability.

The first borderline of the heat transfer plate, i.e. the boundary between the distribution and transition areas, may be non-linear. Thereby, the bending strength of the heat transfer plate may be increased as compared to if the first borderline instead was straight in which case the first borderline could serve as a bending line of the heat transfer plate.

Further, the first borderline may be non-linear in many different ways. In accordance with one embodiment of the present invention, the first borderline is arched and convex seen from the heat transfer area. Such a convex first borderline is longer than a corresponding straight first borderline would be which results in a larger "outlet" of the discharge area which, in turn, contributes to the distribution of the fluid across the width of the heat transfer plate. Thereby, the distribution area can be made smaller with maintained distribution efficiency.

The distribution pattern may be such that the distribution projections are arranged in projection sets and the distribution depressions are arranged in depression sets. Further, the distribution projections of each projection set are arranged along a respective imaginary projection line extending from a respective first distribution projection to the first borderline. Similarly, the distribution depressions of each depression set are arranged along a respective imaginary depression line extending from a respective first distribution depression to the first borderline. A front side main flow path across the distribution area is defined by two adjacent projection lines and a back side main flow path across the distribution area is defined by two adjacent depression lines. Further, the distribution pattern may be such that the projection lines cross the depression lines in crossing points to form a grid. One example of a pattern with the above construction is the so-called chocolate pattern which is a well-known and effective distribution pattern.

The crossing point of each projection line that is closest to the first borderline may be arranged on an imaginary connection line, which connection line is parallel to the first borderline. This arrangement means that the distance between each outermost crossing point of the grid and the first borderline is the same which is advantageous to the strength of the heat transfer plate. The above connection line may even coincide with the first borderline which may result in an optimization of the strength of the heat transfer plate.

The transition pattern of the heat transfer plate may be such that an imaginary extension line extending along each transition projection is similar to a respective part of a third borderline which delimits the distribution and transition areas and extends parallel to a longest one of the projection lines and further through a respective end point of the first and second borderlines. Additionally, each of the rest of the projection lines may also be similar to a respective part of said longest one of the projection lines. According to these embodiments the transition pattern may be adapted to the distribution pattern, wherein the transition projections may be formed as "elongations" of the projection lines of the distribution pattern. Thereby, a "smooth" transition between the distribution and transition areas is enabled. Such a "smooth" transition is associated with a low pressure drop which is beneficial from a fluid distribution point of view. More particularly, it enables a more effective distribution of the fluid across the width of the heat transfer plate, especially across the outer part, arranged along the second long side, of the second half of the heat transfer plate.

The inventive heat transfer plate may be so constructed that a first distance between two adjacent ones of the transition projections is smaller than a second distance between two adjacent ones of the projection lines of the distribution area. Consequently, the surface enlargement, and thus the heat transfer capacity, may be larger within the transition area than within the distribution area. Further, as explained by way of introduction, more densely arranged transition projections is associated with more densely arranged contact areas between two adjacent heat transfer plates which is beneficial to the strength of the heat transfer plates.

According to one embodiment of the heat transfer plate, the transition pattern is such that the transition contact area of each transition projection that is closest to the first borderline is arranged on an imaginary contact line, which contact line is parallel to the first borderline. This arrangement means that the distance between each outermost transition contact area and the first borderline is the same which is advantageous to the strength of the heat transfer plate.

Just like the first borderline of the heat transfer plate, the second borderline, i.e. the boundary between the transition and heat transfer areas, may be non-linear, for example arched and convex seen from the heat transfer area, resulting in the same advantages.

The plate heat exchanger according to the present invention comprises a heat transfer plate as described above.

Still other objectives, features, aspects and advantages of the invention will appear from the following detailed description as well as from the drawings.

BRIEF DESCRIPTION OF THE DRAWINGS

The invention will now be described in more detail with reference to the appended schematic drawings, in which.

DETAILED DESCRIPTION

Figure 1A:
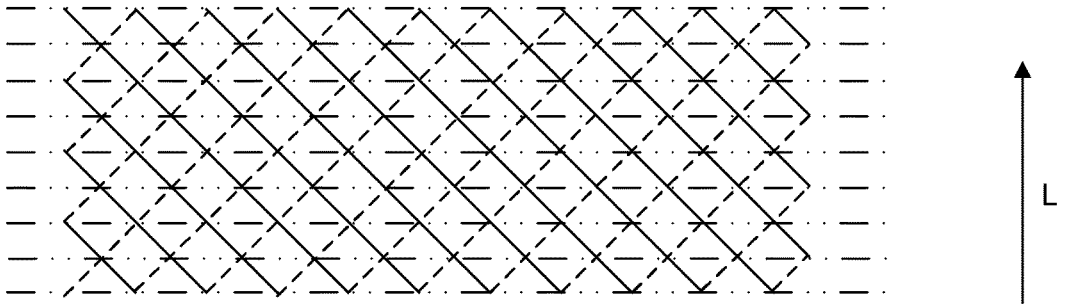
FIG. 1*a*-1*c* illustrate contact areas between different pairs of heat transfer plate patterns.
Figure 1B:
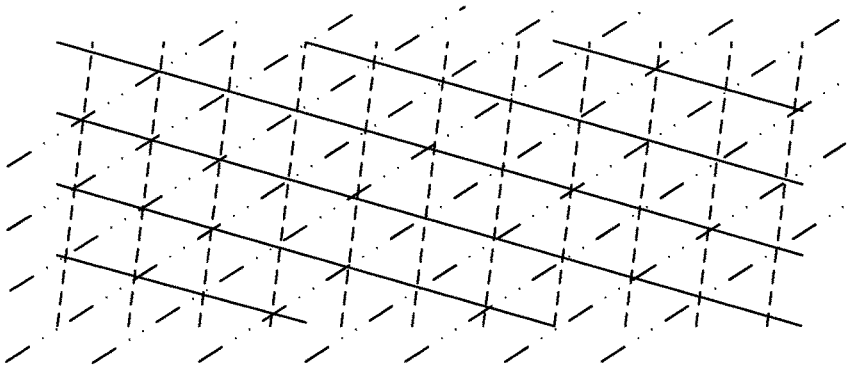
Figure 1C:
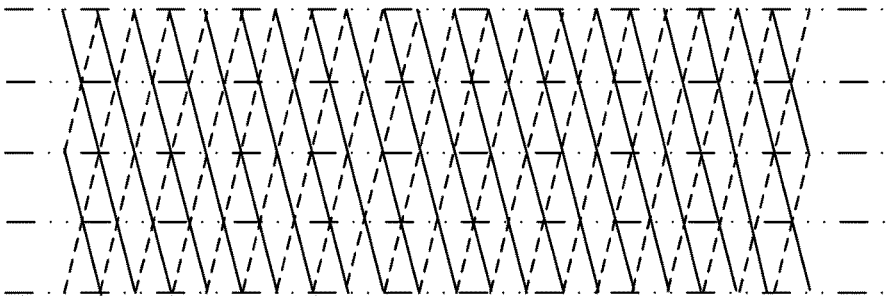
Figure 2:
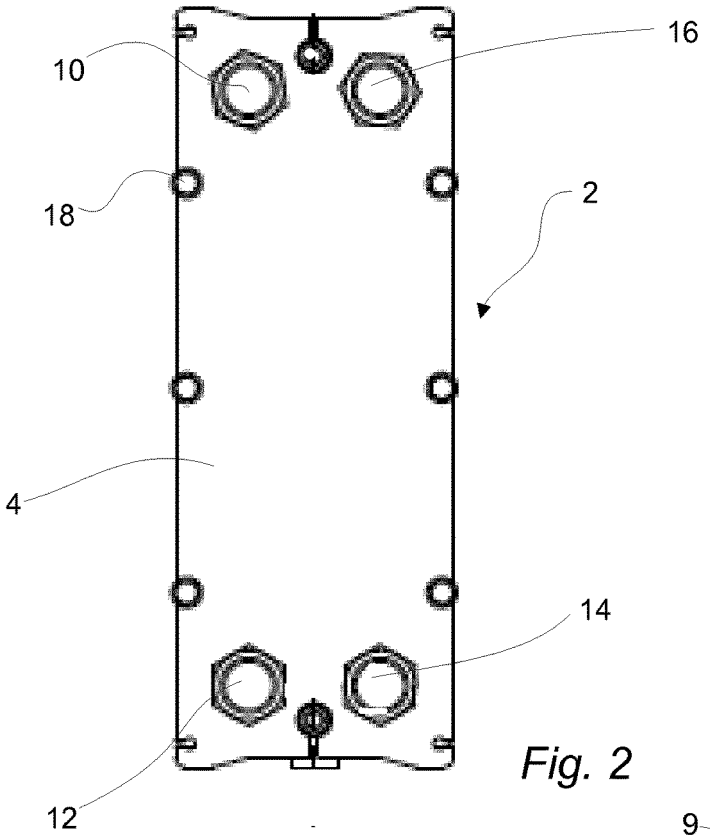
FIG. 2 is a front view of a plate heat exchanger.
Figure 3:
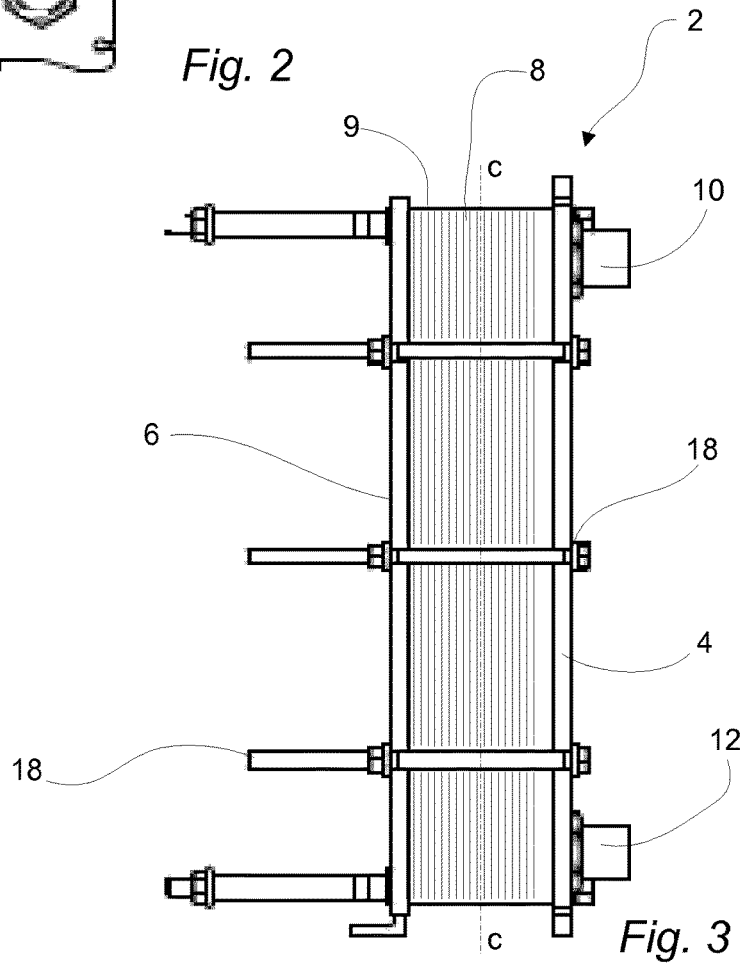
FIG. 3 is a side view of the plate heat exchanger of FIG. 2.

With reference to FIGS. 2 and 3, a gasketed plate heat exchanger 2 is shown. It comprises a first end plate 4, a second end plate 6 and a number of heat transfer plates arranged between the first and second end plates 4 and 6, respectively. The heat transfer plates are of two different types. One type has a medium-theta heat transfer pattern, while the other one has a high-theta heat transfer pattern, the types otherwise being essentially similar. One of the heat transfer plates with medium-theta heat transfer pattern, denoted 8, is illustrated in further detail in FIG. 4. The different heat transfer plates are alternately arranged in a plate pack 9 with a front side (illustrated in FIG. 4) of one heat transfer plate facing the back side of a neighboring heat transfer plate. Every second heat transfer plate is rotated 180 degrees, in relation to a reference orientation (illustrated in FIG. 4), around a normal direction of the figure plane of FIG. 4.

The heat transfer plates are separated from each other by gaskets (not shown). The heat transfer plates together with the gaskets form parallel channels arranged to receive two fluids for transferring heat from one fluid to the other. To this end, a first fluid is arranged to flow in every second channel and a second fluid is arranged to flow in the remaining channels. The first fluid enters and exits the plate heat exchanger 2 through inlet 10 and outlet 12, respectively. Similarly, the second fluid enters and exits the plate heat exchanger 2 through inlet 14 and outlet 16, respectively. The above inlets and outlets will not be described in detail herein. Instead, reference is made to applicant's co-pending patent application "Heat exchanger plate and plate heat exchanger comprising such a heat exchanger plate", filed on the same date as the present application and hereby incorporated herein. For the channels to be leak proof, the heat transfer plates must be pressed against each other whereby the gaskets seal between the heat transfer plates. To this end, the plate heat exchanger 2 comprises a number of tightening means 18 arranged to press the first and second end plates 4 and 6, respectively, towards each other.

Figure 4:
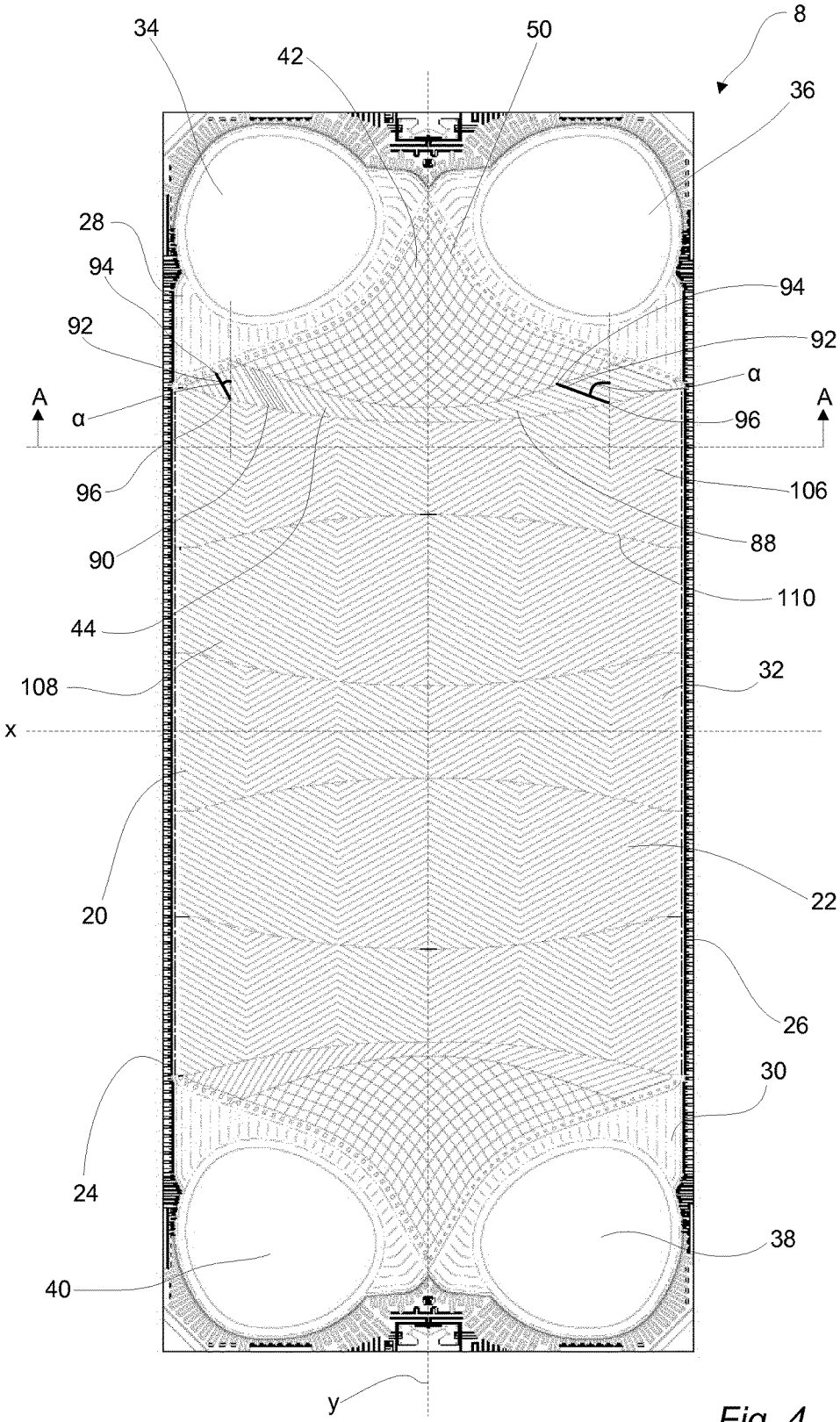
FIG. 4 is a plan view of a heat transfer plate.
Figure 5:
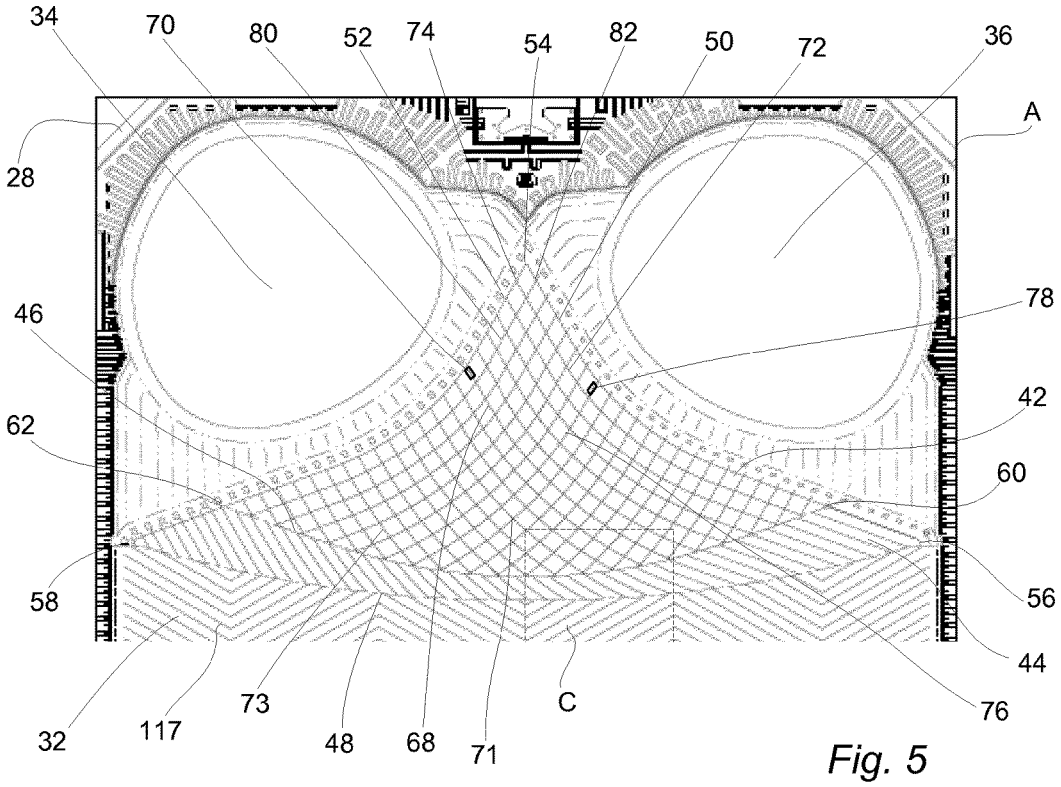
FIG. 5 is an enlargement of a part of the heat transfer plate of FIG. 4, FIG. 6 comprises an enlargement of a portion of the heat transfer plate part of FIG. 5 and illustrates schematically contact areas of a section of the heat transfer plate.

The heat transfer plate 8 will now be further described with reference to FIGS. 4, 5 and 6 which illustrate the complete heat transfer plate, a part A of the heat transfer plate and a portion C of the heat transfer plate part A, respectively, and FIGS. 7, 8, 9 and 10 which illustrate cross sections of projections and depressions of the heat transfer plate. The heat transfer plate 8 is an essentially rectangular sheet of stainless steel. It has a central extension plane c-c (see FIG. 3) parallel to the figure plane of FIGS. 4, 5 and 6, and to a longitudinal center axis y of the heat transfer plate 8. The longitudinal center axis y divides the heat transfer plate 8 into a first half 20 and a second half 22 having first long side 24 and a second long side 26, respectively. The heat transfer plate 8 comprises a first end area 28, a second end area 30 and a heat transfer area 32 arranged there between. In turn, the first end area 28 comprises an inlet port hole 34 for the first fluid and an outlet port hole 36 for the second fluid arranged for communication with the inlet 10 and the outlet 16, respectively, of the plate heat exchanger 2. Similarly, in turn, the second end area 30 comprises an inlet port hole 38 for the second fluid and an outlet port hole 40 for the first fluid arranged for communication with the inlet 14 and the outlet 12, respectively, of the plate heat exchanger 2. Hereinafter, only the first one of the first and second end areas will be described since the structures of the first and second end areas are the same but mirror inverted with respect to a transverse center axis x.

The first end area 28 comprises a distribution area 42 and a transition area 44. A first borderline 46 separates the distribution and transition areas and the transition area 44 borders on the heat transfer area 32 along a second borderline 48. Third and fourth borderlines 50 and 52, respectively, which extend from a connection point 54 to a respective end point 56 and 58 of the second borderline 48 via a respective end point 60 and 62 of the first borderline 46, delimit the distribution area 42 and the transition area 44 from the rest of the first end area 28. The distribution area extends from the first borderline 46 in between the inlet and outlet port holes 34 and 36, respectively. The first and second borderlines 46 and 48, respectively, are both concave seen from the distribution area 42. However, the first borderline 46 has a sharper curvature than the second borderline 48 resulting in a transition area 44 with a varying width.

Figure 6:
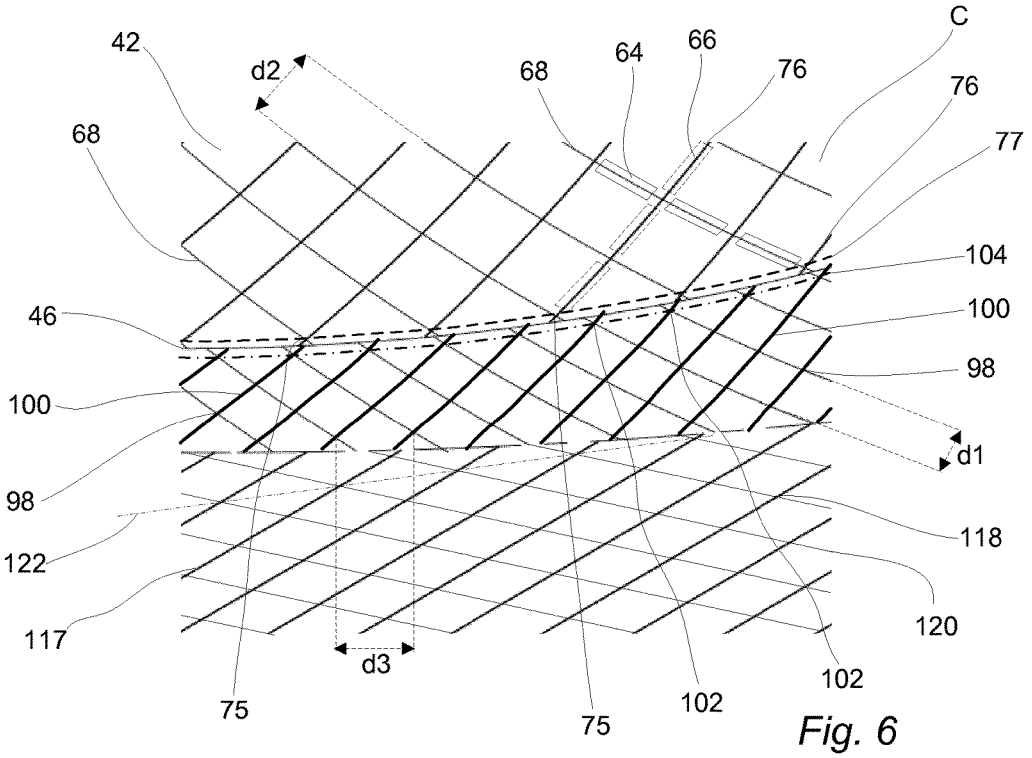
Figure 7:
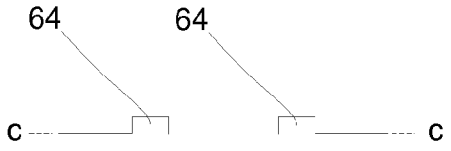
FIG. 7 is a schematic cross section of distribution projections of a distribution pattern of the heat transfer plate.

The distribution area 42 is pressed with a distribution pattern of elongate distribution projections 64 (solid quadrangles) and distribution depressions 66 (dashed quadrangles) in relation to the central extension plane c-c, see FIG. 6. Only a few of these distribution projections and depressions are illustrated in the figures. The distribution projections 64 are divided into a number of projection sets, and the distribution projections of each projection set are arranged along a respective imaginary projection line 68 extending from the first distribution projection 70 of the projection set to the first borderline 46. FIG. 7 illustrates the cross section of the distribution projections 64 taken essentially perpendicular to the respective imaginary projection lines 68. The longest one of the projection lines 68 is the one closest to the outlet port hole 36 and it is denoted 72. The rest of the projection lines are all similar to a respective part of the longest projection line 72, which part extends from an end point 74 of the longest projection line. Thus, all the projection lines 68 are parallel. Also the third borderline 50 is parallel to the projection lines 68.

Figure 8:
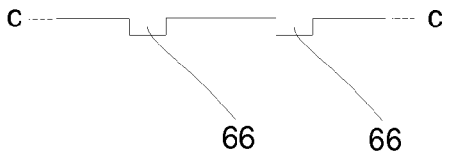
FIG. 8 is a schematic cross section of distribution depressions of the distribution pattern of the heat transfer plate.

Similarly, the distribution depressions 66 are divided into a number of depression sets, and the distribution depressions of each depression set are arranged along a respective imaginary depression line 76 extending from the first distribution depression 78 of the depression set to the first borderline 46. FIG. 8 illustrates the cross section of the distribution depressions 66 taken essentially perpendicular to the respective imaginary depression line 76. The longest one of the depression lines 76 is the one closest to the inlet port hole 34 and it is denoted 80. The rest of the depression lines are all similar to a respective part of the longest depression line 80, which part extends from an end point 82 of the longest depression line. Thus, all the depression lines 76 are parallel. Also the fourth borderline 52 is parallel to the depression lines 76. The longest depression line 80 and the longest projection line 72 are similar but mirror inverted with respect to the longitudinal center axis y.

The imaginary projection lines 68 of the distribution projections 64 cross the imaginary depression lines 76 of the distribution depressions 66 in crossing points 71 to form a grid 73. The crossing point of each projection line 68 that is closest to the first borderline 46 is denoted 75 and arranged on an imaginary connection line 77 (illustrated dashed only in FIG. 6). The connection line 77 is parallel to the first borderline 46. As previously discussed, this contributes to a high strength of the heat transfer plate 8 at the transition between the distribution and transition areas 42 and 44, respectively. The distribution projections 64 of the heat transfer plate 8 are arranged to contact, along their complete extension, respective distribution depressions within the second end area of an overhead heat transfer plate while the distribution depressions 66 are arranged to contact, along their complete extension, respective distribution projections within the second end area of an underlying heat transfer plate. The distribution pattern is a so-called chocolate pattern.

Figure 9:
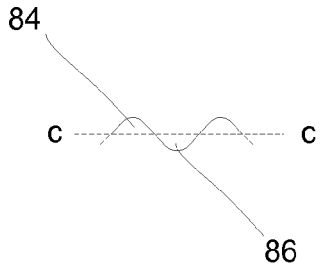
FIG. 9 is a schematic cross section of transition projections and transition depressions of a transition pattern of the heat transfer plate.

The transition area 44 is pressed with a transition pattern of alternately arranged transition projections 84 and transition depressions 86 (FIG. 9) in the form of ridges and valleys, respectively, in relation to the central extension plane c-c, which ridges and valleys all extend from the second borderline 48. In FIG. 4, the tops of these ridges are illustrated with imaginary extension lines 88 while the bottoms of these valleys (but just a few of them) are illustrated with imaginary extension lines 90. In FIGS. 5 and 6, for the sake of clarity, only the imaginary extension lines 88 of the ridges or transition projections 84 are illustrated. FIG. 9 illustrates the cross section of the transition projections 84 and the transition depressions 86 taken essentially perpendicular to the respective imaginary extension lines 88 and 90. Each of the extension lines 88 and 90 is similar to a respective part of the third borderline 50. More particularly, an extension line close to the first long side 24 of the heat transfer plate 8 is similar to an upper portion of the third borderline 50 while an extension line close to the second long side 26 is similar to a lower portion of the third borderline, and an extension line in the center of the heat transfer plate is similar to a center portion of the third borderline. Thus, the transition pattern is adapted to the distribution pattern which results in a relatively smooth transition between the distribution area 42 and the transition area 44 which in turn is beneficial to the fluid distribution across the heat transfer plate.

The third borderline 50 comprises straight as well as curved portions which means that also the extension lines 88 and 90, and thus the transition projections 84 and the transition depressions 86, will comprise straight as well as curved portions. Further, the transition pattern is "divergent" meaning that the transition projections 84, and also the transition depressions 86, are non-parallel. More particularly, an angle $\alpha$ between the longitudinal center axis y and an imaginary straight line 92, which extends between two end points 94 and 96 of each transition projection 84 and transition depression 86 (illustrated for two of the transition projections in FIG. 4), varies between the transition projections and depressions and increases in a direction from the first long side 24 to a second long side 26 of the heat transfer plate 8. In other words, the transition projections 84 and transition depressions 86 are steeper close to the first long side than close to the second long side. As previously explained, this is beneficial to the fluid distribution across the heat transfer plate.

The transition projections 84 comprise essentially point shaped transition contact areas 98 arranged for engagement with respective point shaped transition contact areas of the transition depressions within the second end area of an overhead heat transfer plate. This is illustrated in FIG. 6 where the bottom of these overhead transition depressions have been illustrated with imaginary extension lines 100. It should be stressed that FIG. 6 does not illustrate the engagement with the overhead heat transfer plate outside the transition and heat transfer areas. Similarly, the transition depressions 86 comprise essentially point shaped transition contact areas arranged for engagement with respective point shaped transition contact areas of the transition projections within the second end area of an underlying heat transfer plate (not illustrated). The transition pattern is a so-called herringbone pattern.

The transition contact area of each transition projection 84 that is closest to the first borderline 46 is denoted 102 and arranged on an imaginary contact line 104 (illustrated dashed-dotted only in FIG. 6) which is parallel to the first borderline 46. As previously discussed, this contributes to a high strength of the heat transfer plate 8 at the transition between the distribution and transition areas 42 and 44, respectively.

The heat transfer area 32 is divided into a number of heat transfer sub areas arranged in succession along the longitudinal center axis y of the heat transfer plate 8. A heat transfer sub area 106 adjoins the transition area 44 along the second borderline 48 and a heat transfer sub area 108 along a fifth borderline 110. The second and fifth borderlines are similar but mirror inverted with respect to an axis parallel to the transverse center axis x. Thus, the fifth borderline 110 is convex seen from the transition area 44. In line with what has been previously discussed, this contributes to a high strength of the heat transfer plate 8 at the transition between the heat transfer sub areas 106 and 108, respectively. As seen in FIG. 4, similar arched borderlines can be found also between the other heat transfer sub areas.

Figure 10:
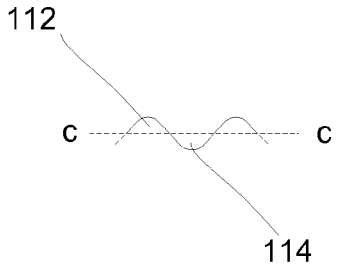
FIG. 10 is a schematic cross section of heat transfer projections and heat transfer depressions of a heat transfer pattern of the heat transfer plate.

The heat transfer sub areas are of two different types which are alternately arranged. Hereinafter, the heat transfer sub area 106 will be described with reference to FIGS. 4, 5, 6 and 10. It is pressed with a heat transfer pattern of alternately arranged essentially straight heat transfer projections 112 and heat transfer depressions 114 in the form of ridges and valleys, respectively, in relation to the central extension plane c-c. The heat transfer pattern of the first half 20 of the heat transfer plate and the heat transfer pattern of the second half 22 of the heat transfer plate 8 are similar but mirror inverted with respect to the longitudinal center axis y. Further, the heat transfer projections and depressions within the first half 20 are parallel meaning that also the heat transfer projections and depressions within the second half 22 are parallel. In FIGS. 4, 5 and 6 the tops of the heat transfer projections 112 are illustrated (bottoms not illustrated) with imaginary extension lines 117. FIG. 10 illustrates the cross section of the heat transfer projections 112 and the heat transfer depressions 114 taken perpendicular to the respective extension lines 117.

The heat transfer projections 112 comprise essentially point shaped heat transfer contact areas 118 arranged for engagement with respective point shaped heat transfer contact areas of heat transfer depressions of an overhead heat transfer plate. This is illustrated in FIG. 6 where the bottom of these overhead heat transfer depressions have been illustrated with imaginary extension lines 120. As explained by way of introduction, since the heat transfer plate 8 has a medium-theta heat transfer pattern while the overhead heat transfer plate has a high-theta heat transfer pattern, the contact areas between the two heat transfer plates will be arranged along imaginary parallel straight lines 122 that are non-perpendicular to the longitudinal center axis y of the heat transfer plate 8. Thus, if the heat transfer plates had not been provided with transition areas, the strength of the heat transfer plates at the transition to the distribution area would have been relatively low. Similarly, the heat transfer depressions 114 comprise essentially point shaped heat transfer contact areas arranged for engagement with respective point shaped heat transfer contact areas of heat transfer projections of an underlying heat transfer plate (not illustrated). The heat transfer pattern is a so-called herringbone pattern.

As apparent from the figures and especially FIG. 6, a first distance d1 between two adjacent ones of the transition projections 84 (or transition depressions 86) within the transition area 44 is smaller than a second distance d2 between two adjacent ones of the projection lines 68 (or depression lines 76) within the distribution area 42. As previously said, this means that the heat transfer capacity is larger within the transition area 44 than within the distribution area 42.

As explained above, the plate heat exchanger 2 is arranged to receive two fluids for transferring heat from one fluid to the other. With reference to FIG. 4 and the heat transfer plate 8, the first fluid flows through the inlet port hole 34 to the back side (not visible) of the heat transfer plate 8, along a back side flow path through the distribution and transition areas of the first end area, the heat transfer area and the transition and distribution areas of the second end area and back through the outlet port hole 40. A back side main flow path through the distribution areas is defined by two adjacent imaginary depression lines. Similarly, the second fluid flows through an inlet port hole of an overhead heat transfer plate, which inlet port hole is aligned with the inlet port hole 38 of the heat transfer plate 8, to the front side of the heat transfer plate 8. Then, the second fluid flows along a front side flow path through the distribution and transition areas of the second end area, the heat transfer area and the transition and distribution areas of the first end area and back through an outlet port hole of the overhead heat transfer plate, which outlet port hole is aligned with the outlet port hole 36 of the heat transfer plate 8. A front side main flow path through the distribution areas is defined by two adjacent imaginary projection lines.

The above described embodiment of the present invention should only be seen as an example. A person skilled in the art realizes that the embodiment discussed can be varied and combined in a number of ways without deviating from the inventive conception.

As an example, the above specified distribution, transition and heat transfer patterns are just exemplary. Naturally, the invention is applicable in connection with other types of patterns. As an example, the projection lines, just like the depressions lines, of the distribution pattern need not be parallel but may diverge from each other. Moreover, the third and fourth borderlines delimiting the distribution and transition areas need not be similar to each other nor parallel to the projection and depression lines, respectively. Further, the first borderline between the distribution area and the transition area could coincide with the connection line on which the outermost crossing points of the distribution pattern are arranged.

In the above described embodiment the curvature of the first borderline is determined by the locations of the imaginary crossing points of the distribution pattern. On the contrary, the curvature of the second borderline is determined by the borderlines between the heat transfer sub areas. The latter is to enable pressing of the heat transfer plate with a modular tool which is used to manufacture heat transfer plates of different sizes containing different numbers of heat transfer sub areas by addition/removal of heat transfer sub areas adjacent to the transition areas. Naturally, according to an alternative embodiment, the first and second borderlines could instead be parallel. Further, also the second borderline could be adapted to the locations of the contact areas within the transition and/or heat transfer patterns for increased strength of the heat transfer plate.

Further, all or some of the first and second borderlines and the borderlines separating the heat transfer sub areas can have another form than a curved one, such as a wave form, a saw tooth form or a straight form.

The above described plate heat exchanger is of parallel counter flow type, i.e. the inlet and the outlet for each fluid are arranged on the same half of the plate heat exchanger and the fluids flow in opposite directions through the channels between the heat transfer plates. Naturally, the plate heat exchanger could instead be of diagonal flow type and/or a co-flow type.

Two different types of heat transfer plates are comprised in the plate heat exchanger above. Naturally, the plate heat exchanger could alternatively comprise only one plate type or more than two different plate types. Further, the heat transfer plates could be made of other materials than stainless steel. Finally, the present invention could be used in connection with other types of plate heat exchangers than gasketed ones, such as plate heat exchangers comprising permanently joined heat transfer plates.

It should be stressed that the term "contact area" is used herein both to specify the areas of a single heat transfer plate that engage with another heat transfer plate, and the areas of mutual engagement between two adjacent heat transfer plates.

It should be stressed that a description of details not relevant to the present invention has been omitted and that the figures are just schematic and not drawn according to scale. It should also be said that some of the figures have been more simplified than others. Therefore, some components may be illustrated in one figure but left out on another figure.

The invention claimed is:

1. A heat transfer plate having a central extension plane and comprising a first end area, a heat transfer area and a second end area arranged in succession along a longitudinal center axis of the heat transfer plate, which longitudinal center axis divides the heat transfer plate into a first and a second half delimited by a first and second long side, respectively, the first end area comprising an inlet port hole arranged within the first half of the heat transfer plate, a distribution area and a transition area, the transition area adjoining the distribution area along a first borderline and the transition area adjoining the heat transfer area along a second borderline, the distribution area having a distribution pattern of distribution projections and distribution depressions in relation to the central extension plane, the transition area having a transition pattern of transition projections and transition depressions in relation to the central extension plane and the heat transfer area having a heat transfer pattern of heat transfer projections and heat transfer depressions in relation to the central extension plane, the transition pattern differing from the distribution pattern and the heat transfer pattern, the transition projections comprising transition contact areas arranged for contact with another heat transfer plate, and an imaginary straight line extending between two end points of each transition projection with an angle in relation to the longitudinal center axis, wherein the angle is varying between the transition projections and increasing in a direction from the first long side to the second long side.

2. A heat transfer plate according to claim 1, wherein the first borderline is non-linear.

3. A heat transfer plate according to claim 1, wherein the first borderline is arched and convex seen from the heat transfer area.

4. A heat transfer plate according to claim 1, wherein the distribution projections are arranged in projection sets and the distribution depressions are arranged in depression sets, the distribution projections of each projection set being arranged along a respective imaginary projection line extending from a respective first distribution projection to the first borderline, and the distribution depressions of each depression set being arranged along a respective imaginary depression line extending from a respective first distribution depression to the first borderline, a front side main flow path across the distribution area being defined by two adjacent projection lines and a back side main flow path across the distribution area being defined by two adjacent depression lines.

5. A heat transfer plate according to claim 4, wherein the projection lines cross the depression lines in crossing points to form a grid.

6. A heat transfer plate according to claim 5, wherein the crossing point of each projection line that is closest to the first borderline is arranged on an imaginary connection line, which connection line is parallel to the first borderline.

7. A heat transfer plate according to claim 6, wherein the imaginary connection line coincides with the first borderline.

8. A heat transfer plate according to claim 4, wherein an imaginary extension line extending along each transition projection is similar to a respective part of a third borderline delimiting the distribution area and the transition area and extending parallel to a longest one of the projection lines and further through a respective end point of the first and second borderlines.

9. A heat transfer plate according to claim 8, wherein each of the rest of the projection lines is similar to a respective part of said longest one of the projection lines.

10. A heat transfer plate according to claim 4, wherein a first distance between two adjacent ones of the transition projections is smaller than a second distance between two adjacent ones of the projection lines of the distribution area.

11. A heat transfer plate according to claim 1, wherein the transition contact area of each transition projection that is closest to the first borderline is arranged on an imaginary contact line, which imaginary contact line is parallel to the first borderline.

12. A heat transfer plate according to claim 1, wherein the second borderline is non-linear.

13. A heat transfer plate according to claim 1, wherein the second borderline is arched and convex seen from the heat transfer area.

14. A plate heat exchanger comprising a heat transfer plate according to claim 1.

* * * * *